US011377336B2

(12) United States Patent
Newton

(10) Patent No.: US 11,377,336 B2
(45) Date of Patent: Jul. 5, 2022

(54) FUNNEL

(71) Applicant: Manvell Newton, Brisbane (AU)

(72) Inventor: Manvell Newton, Brisbane (AU)

(73) Assignee: Manvell Newton, Queensland (AU)

( * ) Notice: Subject to any disclaimer, the term of this patent is extended or adjusted under 35 U.S.C. 154(b) by 0 days.

(21) Appl. No.: 16/944,418

(22) Filed: Jul. 31, 2020

(65) Prior Publication Data

US 2021/0032084 A1 Feb. 4, 2021

(30) Foreign Application Priority Data

Aug. 2, 2019 (AU) ..... 2019100856

(51) Int. Cl.
*B67C 11/02* (2006.01)
*B67C 11/00* (2006.01)

(52) U.S. Cl.
CPC ..... *B67C 11/02* (2013.01); *B67C 2011/20* (2013.01)

(58) Field of Classification Search
CPC ..... B67C 11/00; B67C 11/02
USPC ..... 141/331–345
See application file for complete search history.

(56) References Cited

U.S. PATENT DOCUMENTS 1,676,986 A * 7/1928 Hilford ..... B67C 11/02 141/300
2,116,979 A * 5/1938 George ..... B67C 11/02 141/365
3,335,769 A * 8/1967 Ilg ..... B65B 39/06 141/340
4,143,690 A * 3/1979 Dunicz ..... B67C 11/02 141/333
4,347,878 A * 9/1982 Schofield ..... B67C 11/02 141/300
4,559,984 A * 12/1985 Wycech ..... B67C 11/00 141/340
4,600,125 A * 7/1986 Maynard, Jr. ..... B67B 7/28 141/330
4,823,848 A * 4/1989 Sentmore, Sr. ..... B67C 11/00 141/334
4,970,817 A * 11/1990 Mansfield ..... B67C 11/02 141/330
D340,460 S * 10/1993 Pollak ..... D15/150
5,389,253 A * 2/1995 Cicconi ..... B01D 29/085 210/248
5,472,025 A * 12/1995 Conrad ..... B65B 39/007 141/331

(Continued)

FOREIGN PATENT DOCUMENTS

GB 2273891 A * 7/1994 ..... B67C 11/02

*Primary Examiner* — Timothy L Maust
(74) *Attorney, Agent, or Firm* — Wegman Hessler

(57) ABSTRACT

The present invention is directed to a funnel for use in refilling a vehicle fuel tank from a container. The funnel is adapted to be fixed to the fuel tank inlet so that a person adding fuel to the vehicle fuel tank does not need to hold it in place during the refilling operation. This allows a person to use both their hands to hold the container containing fuel and decant the fuel in a more controlled manner. The funnel also has an inlet opening where the peripheral rim is substantially horizontal when the funnel is fixed in an operational position. With the peripheral rim being substantially horizontal the funnel is able to receive and direct fuel into the fuel tank with minimal spillage.

6 Claims, 7 Drawing Sheets

(56) References Cited

U.S. PATENT DOCUMENTS 5,634,502 A * 6/1997 Pierce ..... F01M 11/04 141/331
5,676,185 A * 10/1997 Starr ..... B67C 11/02 141/300
5,979,516 A * 11/1999 Grant ..... F01M 11/0408 141/114
D422,674 S * 4/2000 Chrisco ..... D23/200
6,098,678 A * 8/2000 Shears ..... B67C 11/02 141/331
D449,105 S * 10/2001 Azo ..... D24/122
6,340,038 B1 * 1/2002 Ingram ..... B67C 11/02 141/333
6,397,907 B1 * 6/2002 Heintz ..... B67C 11/02 141/331
6,425,424 B1 * 7/2002 Ellis Calvo ..... B65B 39/00 141/331
D467,338 S * 12/2002 Rehrig ..... D24/122
D499,180 S * 11/2004 Best ..... D24/122
7,299,834 B1 * 11/2007 Platt ..... B67C 11/04 141/301
D577,435 S * 9/2008 Ivie ..... D24/122
7,975,734 B2 * 7/2011 Makowiec ..... B67C 11/02 141/342
D649,239 S * 11/2011 Taravella ..... D24/122
D716,908 S * 11/2014 Alesi ..... D23/200
D728,331 S * 5/2015 Wirth ..... D7/700
D868,862 S * 12/2019 Yesnick ..... D15/150
2006/0185763 A1 * 8/2006 Rosenbaum ..... F01M 11/0408 141/338
2007/0079898 A1 * 4/2007 Grover ..... B67C 11/02 141/340
2007/0256755 A1 * 11/2007 King ..... B67C 11/02 141/340
2008/0142114 A1 * 6/2008 Cook ..... B65B 39/00 141/331
2010/0243105 A1 * 9/2010 McGee ..... A01G 25/092 141/334
2012/0267006 A1 * 10/2012 Liao ..... B67C 11/02 141/331
2013/0087245 A1 * 4/2013 Svacha ..... F01P 11/0204 141/331
2018/0327242 A1 * 11/2018 Cremasco ..... B67C 11/02

* cited by examiner

FUNNEL

CROSS REFERENCE TO RELATED APPLICATIONS

This application claims the priority filing benefit of Australian Patent Application No. 2019100856 filed Aug. 2, 2019, which is incorporated herein by reference in its entirety.

FIELD OF INVENTION

The present invention relates to a funnel for use with a vehicle. The present invention has particular but not exclusive application for use in manually pouring fuel into a fuel tank of a vehicle from a fuel container.

BACKGROUND OF THE INVENTION

Filling a car fuel tank from a container, typically a sealable jerry-can, is generally awkward and difficult. A person must insert a funnel into the opening of the vehicle fuel tank and hold it in position while decanting the fuel from the container. The fuel container is often heavy and the process of filling the car fuel tank is slow. Refilling is slow because of the limited volume of fuel that can enter the funnel at any one time. Often the fuel will spill and overflow the sides of the funnel. Spilling of fuel around the opening of the fuel tank will often stain the car.

This problem is not limited to cars. Lawn mowers, large diesel trucks, outboard and inboard motors and any fuel tank associated with a motor faces these problems when trying to manually refill the fuel tank.

OBJECT OF THE INVENTION

It is an object of the present invention to overcome at least in part one or more of the above mentioned problems.

SUMMARY OF THE INVENTION

In one aspect the present invention broadly resides in a funnel that has a wide open inlet at one end and a comparatively narrow outlet at an opposite end, wherein the opposite end is fixable to or within a fuel tank inlet so that in a fixed position the funnel is operational and does not need a person to hold it in position.

A funnel that has a wide open inlet at one end and a comparatively narrow outlet at an opposite end, wherein the opposite end is fixable to or within a fuel tank inlet so that in a fixed position the funnel can be used to receive fuel from a container without the need for the funnel to be held in position.

The funnel can be fixed to the fuel tank inlet by any suitable arrangement including friction-fitting arrangement; complementary locating and fixing features associated with both the funnel outlet and fuel tank opening such as screw threads and bayonet fittings; and adjustable clamping arrangements.

In another aspect the present invention broadly resides in a funnel for use with a fuel tank opening that has a screw thread on or about the opening of the fuel tank, said funnel having a wide open inlet at one end and a comparatively narrow outlet at an opposite end, wherein an outer surface of the funnel at or adjacent the outlet has a screw thread that is complementary to a screw thread associated with the fuel tank opening.

The threaded outer surface of the funnel is preferably arranged so that the funnel can be fastened to the fuel tank opening so that the funnel is in an operational position when the funnel is fastened to the fuel tank.

Preferably the funnel includes a locking nut that locks the fastened funnel and prevents it from accidental movement.

In another aspect the present invention broadly resides in a funnel for use with a fuel tank opening that has one part of a bayonet-type fitting on or about the fuel tank opening, said funnel having a wide open inlet at one end and a comparatively narrow outlet at an opposite end, wherein an outer surface of the funnel at or adjacent the outlet has a complementary second part bayonet-type fitting.

In another aspect the invention broadly resides in a funnel that has a wide open inlet with a periphery that is substantially horizontal when the funnel is fixed to the inlet opening of the fuel tank.

Preferably the funnel is in an upright position when the funnel is fixed to the inlet opening of the fuel tank.

In another aspect the present invention broadly resides in a funnel that has a wide open inlet at one end and a comparatively narrow outlet at an opposite end, said wide open inlet has a periphery; wherein the opposite end is fixable to or within a fuel tank inlet so that in a fixed position the funnel is operational and does not need a person to hold it in position; wherein the inlet periphery is substantially horizontal when the funnel is in an operational position.

In another aspect the present invention broadly resides in a funnel for use with a fuel tank opening that has a screw thread on or about the opening of the fuel tank, said funnel having a wide open inlet at one end and a comparatively narrow outlet at an opposite end, wherein an outer surface of the funnel at or adjacent the outlet has a screw thread that is complementary to a screw thread associated with the fuel tank opening; wherein a periphery of the funnel wide open inlet is substantially horizontal when the funnel is in an operational position.

In another aspect the present invention broadly resides in a funnel for use with a fuel tank opening that has one part of a bayonet-type fitting on or about the fuel tank opening, said funnel having a wide open inlet at one end and a comparatively narrow outlet at an opposite end, wherein an outer surface of the funnel at or adjacent the outlet has a complementary second part bayonet-type fitting; wherein a periphery of the funnel wide open inlet is substantially horizontal when the funnel is in an operational position.

In another aspect the present invention broadly resides in a funnel for use with a fuel tank opening that has one part of a bayonet-type fitting or threaded portion on or about the fuel tank opening, said funnel having a wide open inlet at one end and a comparatively narrow outlet at an opposite end, wherein an outer surface of the funnel at or adjacent the outlet has a complementary second part bayonet-type fitting or a complementary threaded portion depending on the respective connector type on or about the fuel tank opening; wherein a periphery of the funnel wide open inlet is substantially horizontal when the funnel is in an operational position.

Preferably the funnel has a container portion for holding fuel or other fluid before it is directed down a channel portion. The container portion is preferably oval shaped with the inlet periphery substantially horizontal when the funnel is in an operational position. The container portion is preferably oval shaped so that it can fit beneath a vehicle seat for storage purposes. The container portion is preferably oval shaped with the inlet periphery having an oval shape.

Alternatively, the container portion has a substantially rectangular inlet periphery. Preferably the elongate sides of the containers portion are flat to facilitate storage beneath a vehicle seat.

In another aspect the present invention broadly resides in a funnel that has a wide oval-shaped or substantially rectangular-shaped inlet periphery at one end and a comparatively narrow outlet at an opposite end; wherein the opposite end is fixable to or within a fuel tank inlet so that in a fixed position the funnel is operational; wherein the inlet periphery is substantially horizontal when the funnel is in an operational position.

Preferably the channel portion of the funnel is elongate and shaped to extend past a fuel cap cover so that the container portion is proud of the fuel cap cover.

The channel portion is preferably angled so that when the funnel is in the operational position the container portion is proud of the fuel tank opening and or the fuel cap cover.

The channel portion preferably includes a grip section where a person can hold the funnel. Preferable the grip section includes one or more concentric rings providing an uneven surface to allow a person to grip the funnel.

In another aspect the present invention broadly resides in a funnel that has a wide oval-shaped or substantially rectangular-shaped open inlet at one end and a comparatively narrow outlet at an opposite end, said wide open inlet has a periphery, said funnel includes an elongate curved channel portion and said channel portion has a grip section with one or more concentric rings; wherein the opposite end is fixable to or within a fuel tank inlet so that in a fixed position the funnel is operational; wherein the inlet periphery is substantially horizontal when the funnel is in an operational position.

In another aspect the present invention broadly resides in a funnel for use with a fuel tank opening that has a screw thread on or about the opening of the fuel tank, said funnel having a wide oval-shaped or substantially rectangular-shaped open inlet at one end and a comparatively narrow outlet at an opposite end, said funnel includes an elongate curved channel portion and said channel portion has a grip section with one or more concentric rings wherein an outer surface of the funnel at or adjacent the outlet has a screw thread that is complementary to a screw thread associated with the fuel tank opening; wherein a periphery of the funnel wide open inlet is substantially horizontal when the funnel is in an operational position.

The funnel can include a filter member. A filter member can be selected from a mesh bag or portion thereof insertable within the container portion and a mesh disc positionable within the container portion and serving as a screen for the fuel or fluid. The filter member can alternatively be positioned within the channel portion and more preferably at the opening of the narrow outlet.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENTS

Three preferred embodiments of the funnel will be described in detail. The preferred embodiments are funnels that are used to fasten to the opening inlet of a vehicle fuel tank. These embodiments are by way of example of the invention and the funnel can be used with respect to different containers and fuel tanks and not just in respect of vehicles.

With respect to FIGS. 1 to 4 there is shown a first preferred embodiment of the funnel 10. The funnel 10 has a container portion 11 and a channel portion 12.

Figure 2:
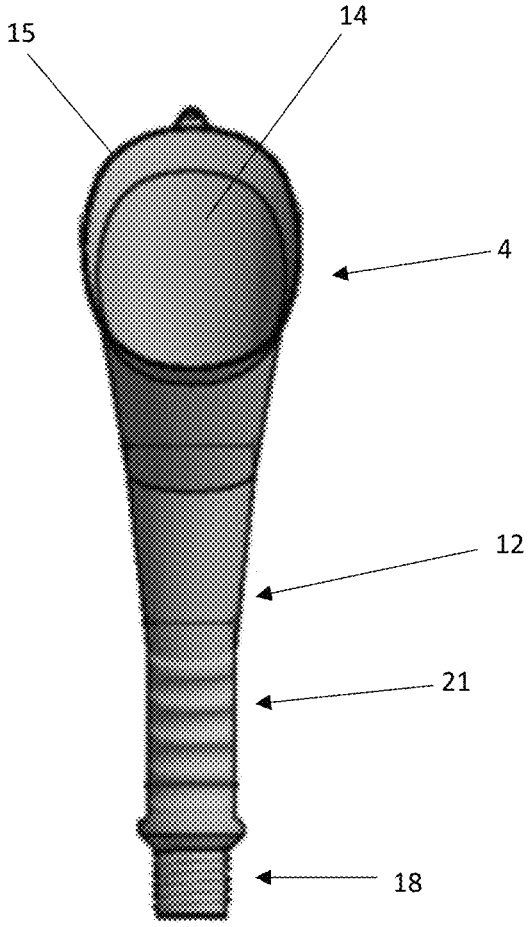
FIG. 2 is a diagrammatic front view of a first preferred embodiment of the funnel.
Figure 3:
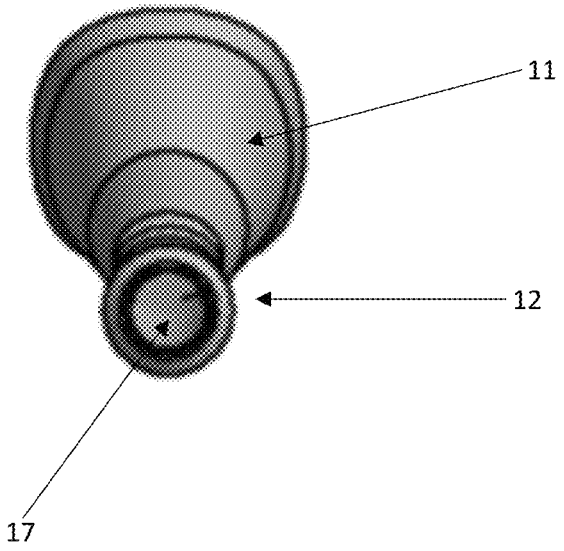
FIG. 3 is a diagrammatic bottom view of a first preferred embodiment of the funnel.
Figure 4:
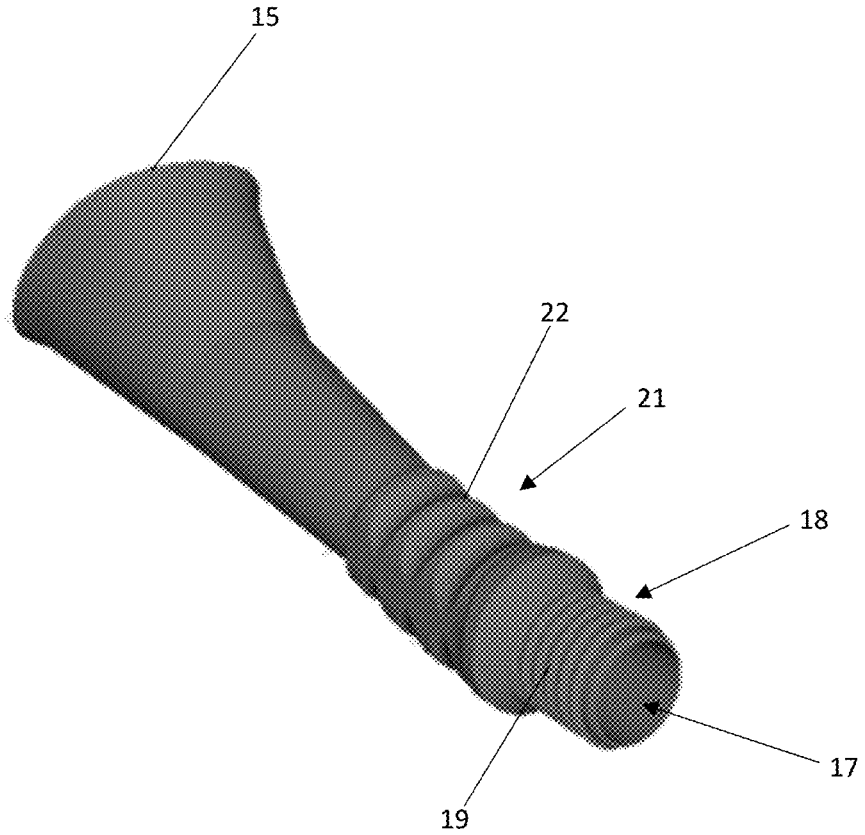
FIG. 4 is a diagrammatic perspective view of a first preferred embodiment of the funnel.

The container portion 11 has a comparatively wide inlet opening 14. The container portion 11 has a substantially oval shape and the wide inlet opening 14 has a peripheral rim 15 that is substantially oval shaped. With reference to FIG. 2, the oval shaped inlet periphery 15 is orientated so that the longitudinal axis of the oval shaped inlet opening 14 is the same or parallel with the longitudinal axis of the funnel 10.

The channel portion 12 has a comparatively narrow outlet opening 17 that is at the opposite end to the wide oval shaped inlet opening 14. Channel portion 12 at or adjacent the outlet opening 17 has a threaded outer surface section 18. The threaded outer surface section 18 has a thread 19 that is complementary to a thread on the inner surface about the fuel tank inlet opening. The arrangement of the thread 19 about the outer surface of the channel portion 12 is such that the funnel 10 can be fitted to the inlet opening of the fuel tank so that it is fastened in a position where the container portion 11 is in an upright position.

The channel portion 12 is elongate and slightly curved. The channel portion 12 is substantially longer than the length of the container portion 11. The length and curvature of the channel portion 12 is arranged so that when the funnel 10 is in an operational position, the container portion 11 is positioned so that the peripheral rim 15 is substantially horizontal, the inlet opening 14 is proud of the vehicle fuel cap cover and spaced from the vehicle fuel cap cover so that fuel can be decanted into the container portion 11 without interference from the fuel cap cover.

The channel portion 12 also has a grip portion 21 adjacent the threaded surface section 18. The grip portion 21 comprises four concentric rings 22 about the channel portion 12 providing an area of an uneven surface to allow a person to grip the funnel 10. The number of rings can vary between two and six rings, but the first preferred embodiment has four concentric rings 22.

Figure 5:
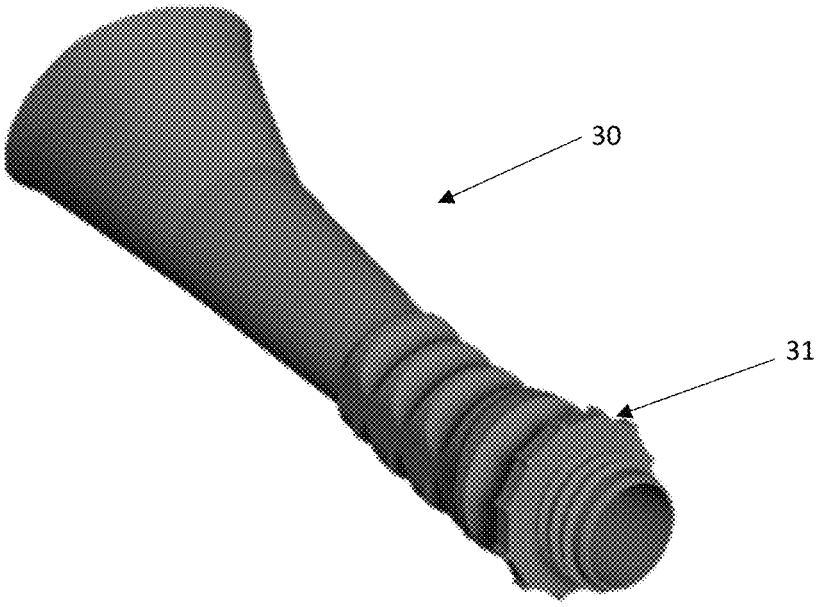
FIG. 5 is a diagrammatic perspective view of a second preferred embodiment of the funnel with a locking nut.
Figure 6:
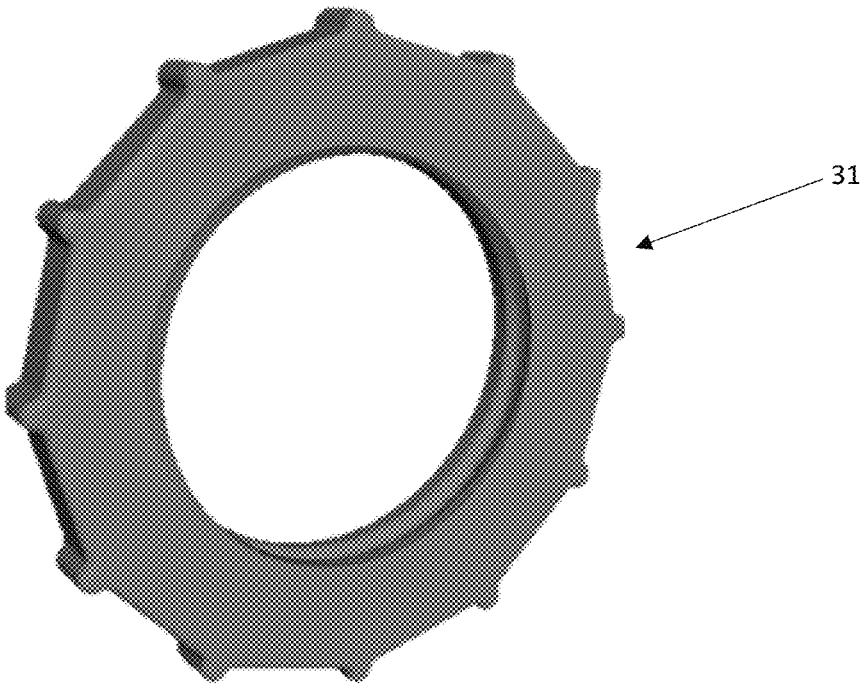
FIG. 6 is a diagrammatic view of a locking nut associated with the second preferred embodiment of the funnel.

With reference to FIGS. 5 and 6, there is shown a second embodiment of the funnel 30. The second embodiment of the funnel 30 has identical features to the first embodiment and for purposes of convenience the features will be numbered similarly. The only difference with the second embodiment is that the funnel 30 has a locking nut 31 that winds onto the thread 19 of the threaded surface portion 18 and secures the fastened funnel 30 in position preventing accidental dislodgement of the funnel 30 from an operational position.

The funnel 10, 30 of the preferred embodiments can be fitted and fastened with the opening of a fuel tank inlet. The thread surface portion 18 has an arrangement of threads 19 that allows the threads 19 to be wound and fastened to the inlet of the fuel tank whereby the wide inlet opening 14 of the funnel 10, 30 is in an upright position and the peripheral rim 15 of the wide inlet opening 14 is substantially horizontal. In the second embodiment, the funnel 30 uses a locking nut 31 to lock the funnel in the operational position to avoid accidental dislodgement of the funnel 30 from the operational position.

When the funnel 10, 30 is in an operational position fastened to the inlet of the vehicle fuel tank a person may decant fuel from a container by lifting the container with both hands thereby controlling the flow of fuel into the wide inlet opening 14 of the funnel 10, 30. The person decanting the fuel does not need to hold the funnel 10, 30 in position and need only direct their attention to pouring the fuel into the funnel 10, 30. Removing the need to hold the funnel 10, 30 in position makes the job of pouring the fuel from a container more manageable, avoids or minimizes accidental spillage and decreases the time needed to decant the fuel from the container.

When the fuel has been added to the fuel tank the funnel 10, 30 is removed by reversing the procedure of fitting the funnel 10, 30. The funnel 10, 30 can be conveniently stored under the seat or in a confined space because of the substantially oval shaped container portion 11.

Figure 1:
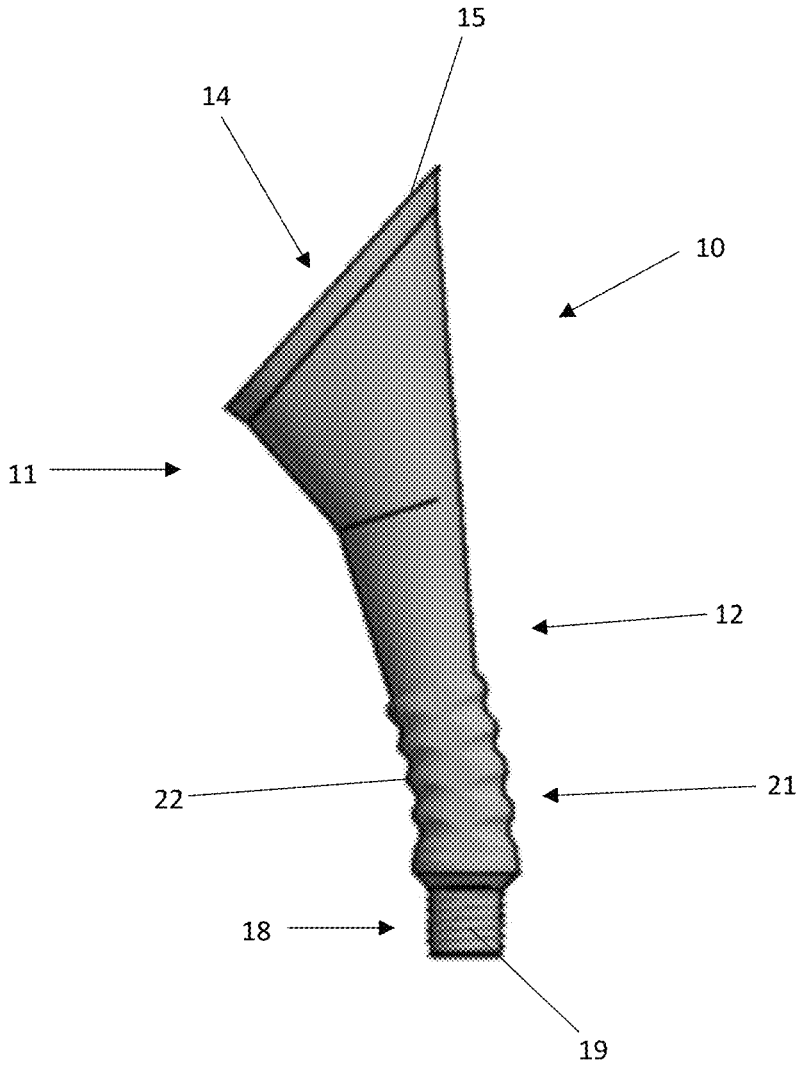
FIG. 1 is a diagrammatic side view of a first preferred embodiment of the funnel.
Figure 7:
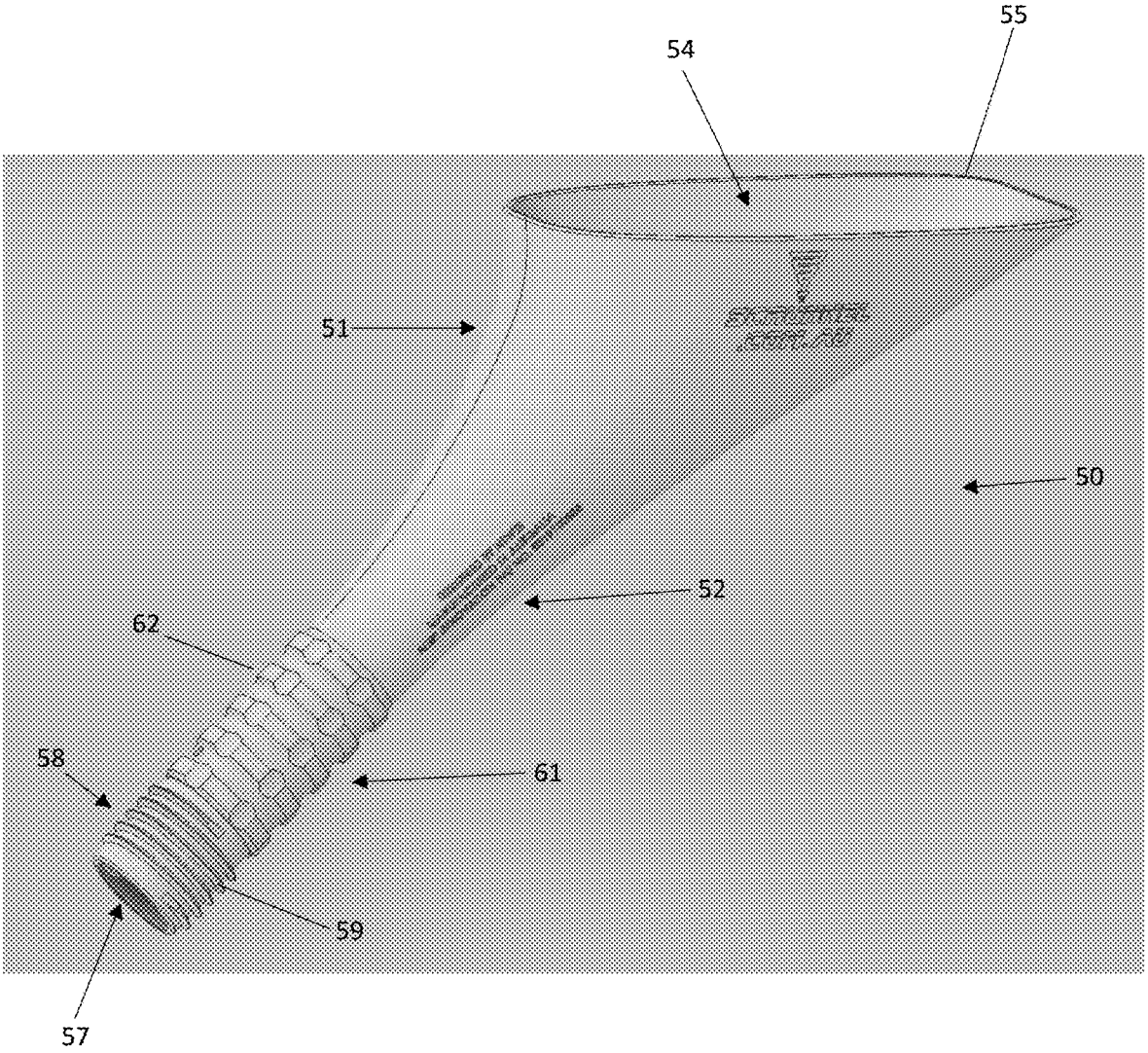
FIG. 7 is a diagrammatic perspective view of a third preferred embodiment of the funnel.

With reference to FIG. 7, there is shown a third preferred embodiment of the funnel 50. The funnel 50 has a container portion 51 and a channel portion 52. The funnel 50 is substantially the same as the funnel 10 and 30 as shown in FIGS. 1 and 5, except that the container portion 51 has a substantially rectangular shape. The funnel 50 also has a comparative wide inlet opening 54 that has a peripheral rim 55. The peripheral rim 55 has a substantially rectangular shape.

The channel portion 52 is elongated and slightly curved. The length and curvature of the channel portion 52 is arranged so that when the funnel 50 is in an operational position, the container portion 51 is positioned so that the peripheral rim 55 is substantially horizontal, the inlet opening 54 is proud of the vehicle fuel cap cover and spaced from the vehicle fuel cap cover so that fuel can be decanted into the container portion 51 without interference from the fuel cap cover.

The funnel 50 also includes a comparatively narrow outlet opening 57. The funnel 50 has a threaded outer surface section 58. The threaded outer surface section 58 has a thread 59 that is complementary to a thread on the inner surface about the fuel tank inlet opening.

In use, the funnel 50 is fitted to the fuel tank inlet opening via thread 59 so that funnel 50 is fixed in a position where the container portion 51 is in an upright position.

The funnel 50 further includes a grip portion 61 adjacent the thread surface section 58. The grip portion 61 comprises five concentric rings 62 about the channel portion 52 to allow a person to grip the funnel 50.

The funnel can be fitted with a locking nut to lock the funnel to or about the fuel tank opening in a similar way as the second preferred embodiment.

The preferred embodiments of the invention are directed to a funnel for use in refilling a vehicle fuel tank from a container. The funnel is adapted to be fixed to the fuel tank inlet so that a person adding fuel to the vehicle fuel tank does not need to hold it in place during the refilling operation. This allows a person to use both their hands to hold the container containing fuel and decant the fuel in a more controlled manner. The funnel also has an inlet opening where the peripheral rim is substantially horizontal when the funnel is fixed in an operational position. With the peripheral rim being substantially horizontal the funnel is able to receive and direct fuel into the fuel tank with minimal spillage.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A funnel for use to decant fuel into a fuel tank where there is a fuel tank inlet on the side of a vehicle, the fuel tank inlet has a screw thread on or about the opening of the fuel tank inlet, comprising:

a container portion that has a wide open inlet;

an elongate channel portion that has a comparatively narrow outlet and a screw thread that is complementary to the screw thread associated with the fuel tank inlet, wherein the elongate channel portion is longer than the length of the container portion, a longitudinal axis of the funnel extends through both the wide open inlet and the narrow outlet to provide an unimpeded flow path;

wherein a peripheral plane of said wide open inlet is at an angle and non-parallel relative to a peripheral plane of said narrow outlet; said container portion and elongate channel portion extends away from a perpendicular axis from the peripheral plane of said wide open inlet; and wherein in use the funnel is attached by the complementary screw threads to the fuel tank inlet so that the wide open inlet is horizontal, proud of the vehicle fuel tank inlet and spaced from a vehicle fuel cap cover so that fuel can be decanted into the container portion without interference from the fuel cap cover or the need to physically hold the funnel.

2. A funnel as in claim 1, wherein said wide open inlet is oval-shaped or substantially rectangular-shaped.

3. A funnel as in claim 1, wherein there is a locking nut that locks the funnel in a fixed position to the fuel tank inlet and prevents it from accidental movement.

4. A funnel as in claim 1, comprising a grip section that includes one or more concentric rings providing an uneven surface to allow a person to grip the funnel.

5. A funnel as in claim 1, wherein said funnel includes a filter member selected from a mesh bag or portion thereof inserted within the container portion and a mesh disc positioned within the container portion.

6. A funnel as in claim 1, wherein there is a filter member that is positioned within the elongate channel portion or at the opening of the narrow outlet.

* * * * *